United States Patent [19]

Darche et al.

[11] Patent Number: 4,498,297

[45] Date of Patent: Feb. 12, 1985

[54] HEAT EXCHANGER MODULE FOR STIRLING ENGINES

[75] Inventors: Michel J. P. Darche, Ville d'Avray; Stig Carlqvist, Paris, both of France

[73] Assignee: Societe ECA, Asnieres, France

[21] Appl. No.: 370,132

[22] Filed: Apr. 20, 1982

[51] Int. Cl.[3] ..... F02G 1/04

[52] U.S. Cl. ..... 60/525

[58] Field of Search ..... 60/517, 524, 525, 526

[56] References Cited

U.S. PATENT DOCUMENTS

| | | | |
|---|---|---|---|
| 2,579,702 | 12/1951 | Rinia et al. | 60/524 |
| 3,795,112 | 3/1974 | Aupor et al. | 60/526 |
| 3,851,472 | 12/1974 | Neelen | 60/517 |
| 4,084,376 | 4/1978 | Asselman et al. | 60/524 |
| 4,267,696 | 5/1981 | Lindskoug | 60/526 |
| 4,298,057 | 11/1981 | Kihlberg et al. | 60/517 |
| 4,307,569 | 12/1981 | Carlqvist | 60/525 |
| 4,365,474 | 12/1982 | Carlqvist | 60/525 |

FOREIGN PATENT DOCUMENTS

| | | | |
|---|---|---|---|
| 0154100 | 3/1952 | Australia | 60/525 |
| 0584648 | 10/1959 | Canada | 60/526 |
| 0041718 | 12/1981 | European Pat. Off. | 60/525 |
| 0156438 | 12/1981 | Japan | 60/525 |
| 0002448 | 1/1982 | Japan | 60/525 |

*Primary Examiner*—Allen M. Ostrager

*Attorney, Agent, or Firm*—Davis, Hoxie, Faithfull & Hapgood

[57] ABSTRACT

The invention relates to Stirling engines and provides a modular assembly composed of a cylinder head, a heater, a regenerator, a cooler and a cold duct, and making it possible by mounting a plurality of identical modules on an engine assembly to construct a multi-cylinder double acting Stirling engine of the indirect heating type.

5 Claims, 5 Drawing Figures

FIG. 3
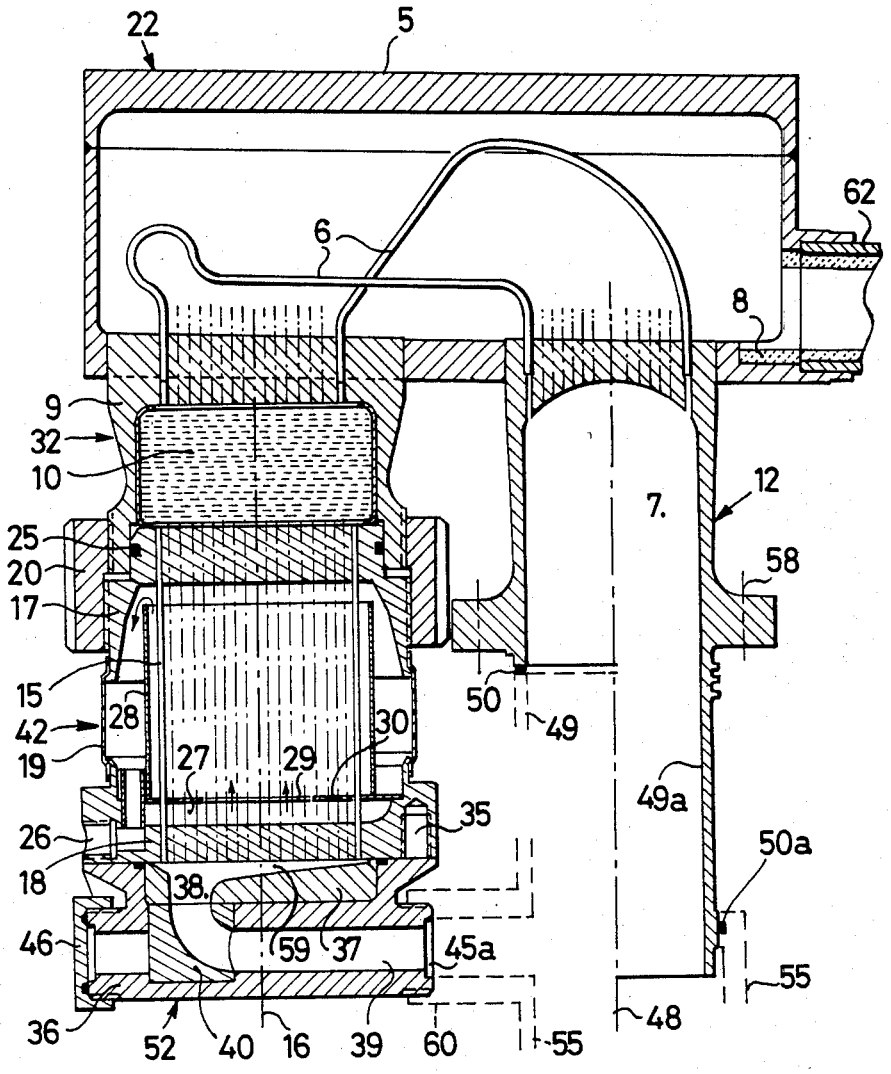
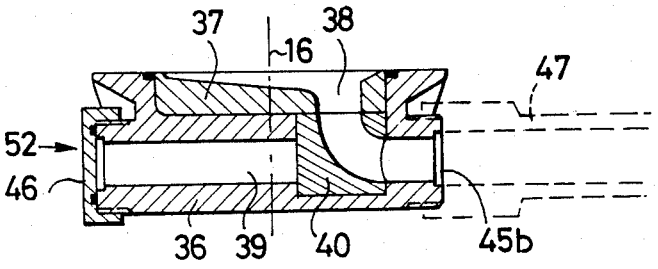
FIG. 4

HEAT EXCHANGER MODULE FOR STIRLING ENGINES

BACKGROUND OF THE INVENTION

It is known that Stirling engines are heat engines of the external heating, piston type, in which the working gas, which is helium or hydrogen, circulates alternately from one cylinder to another, passing through a tubular heat exchanger in which it is heated, a porous metallic matrix known as a regenerator, in which it receives or gives up heat, and another tubular heat exchanger in which it is cooled. The two heat exchangers also enable it to retain its temperature when it is compressed or expanded in the cylinders.

A two-cylinder engine of this type is illustrated diagrammatically in FIG. 1. A kinematic connection comprising connecting rods and a crankshaft is provided between the two pistons in such a manner that the movement of the piston of the "cold" cylinder B is offset 90° C. in relation to that of the "hot" cylinder A. When the crankshaft F turns about one sixth of a turn in the direction indicated by the arrow, starting from the position shown in FIG. 1, the piston of cylinder A moves very little, while the piston of cylinder B compresses the gas which is kept cold by the cooler C. When the next sixth of a revolution is made, the gas is transferred from cylinder B to cylinder A while being heated by the regenerator D and the heater E. During the next sixth of a revolution, the piston of cylinder B moves very little, while the piston of cylinder A allows the gas kept hot by the heater E to expand. In the next half-revolution the gas is transferred from cylinder A to cylinder B while being cooled by the regenerator D and the cooler C, and a new cycle starts. In the course of this complete cycle, as in any heat engine, heat is supplied at high temperature (in the heater), heat is given up at low temperature (in the cooler), and work is done (on the crankshaft). Heating in the heater E is generally effected by passing through it combustion gases from various materials, and cooling is effected in the cooler C by means of a current of cold water.

A known arrangement of this kind can be modified as shown in FIG. 2. The variable cold volume is disposed not above, but below the piston of cylinder B, on the kinematic connection side. The operating principle of the engine is not changed, provided that the movement of the piston of cylinder B is 90° ahead in phase in relation to that of cylinder A, as is shown in this Figure.

The diagram given in FIG. 2 makes it possible to conceive the connection in series of a plurality of engine units of the kind shown in FIG. 2, as is suggested by the pipe outlets shown on cylinders A and B. A double-acting piston engine is then obtained in which each of the pistons works on both its faces, and the power of which is substantially doubled for a given cylinder capacity. Furthermore, the devices sealing the engine in relation to the outside are situated under the cold variable volumes of the cylinders, so that their construction is less difficult. The various engine units, which are generally from three to six in number, preferably form a closed chain in a so-called RINIA arrangement; see, for example, G. Walker, "Stirling Engine Machines", U. of Bath 1971. This principle has been adopted for almost all existing Stirling engines.

For good thermodynamic functioning it is necessary in practice that the hot ducts between A and E in FIG. 2 and the cold ducts between B and C, constituting dead volumes and causing pressure drops, should be shortened as much as possible; in order to reduce deformation, play and friction, it is also necessary that the kinematic connection between the various piston rods should simplified as far as possible. Finally, when heating is effected by combustion gases, it is necessary for the tubes of the heater E to be grouped to form a single heating head permitting uniform distribution of the heat.

A very compact engine complying with the conditions set forth above is obtained by disposing four cylinders in a square. The piston rods may be parallel and may operate an inclined plate (swash plate or wobble plate) or a double crankshaft (H type engine); they may also be inclined in V form and drive a single crankshaft (double V type engine). These various arrangements are those most generally adopted in present Stirling engines.

As a setoff to compactness, these Stirling engines lose the modular character which it would have been possible to obtain by connecting a plurality of engine units in series in accordance with the diagram shown in FIG. 2. They are composed of a single engine assembly in which only small components, such as regenerators, coolers or pistons, are manufactured as sets of identical parts.

SUMMARY OF THE INVENTION

The object of the present invention is a heat exchanger module for Stirling engines, which comprises in known manner a tubular heater, a regenerator and a tubular cooler, together with at least one cylinder part, the regenerator and the cooler forming an assembly of generally cylindrical shape, whose axis is parallel to the axis of the cylinder head, and this module being designed to permit the construction of a double acting Stirling engine by mounting a plurality of identical modules on an engine assembly equipped with in-line pistons connected to a crankshaft, while the cooler of each module of the engine is connected by a cold duct to the base of the cylinder which corresponds to an adjacent module. In a module of this kind, according to the invention, the heater is of the indirect heating type and its tubes are enclosed in a housing which rigidly connects the cylinder head and the regenerator housing.

The modular design according to the invention offers numerous advantages. The various engine units making up the engine are strictly identical, including the hot and cold ducts connecting the heat exchangers to the engine assembly, so that the operation of the engine is perfectly regular. Designing and adjustment tests are simplified because of the existence of identical units in the engine. The cost of manufacture of parts and assembly of units for general tests, construction of engines and supply of spares is reduced because of the increased number of identical components. Maintenance requires a smaller stock of parts. Engines differing in respect of shape or number of cylinders can easily be constructed from the same modules.

The tubes of the cooler are preferably rectilinear and directed parallel to the axis of the cooler, while its outside wall is made of a flexible material so that it is capable of absorbing, with concomitant deformation of these tubes in S shape, the effects of thermal expansions of the heater in relation to the engine assembly as the result of the considerable differences in temperature which occur between these elements in the course of operation.

In order to give substantially the same length to the cold ducts between the modules of one and the same engine, whether these ducts connect two adjacent modules or connect two modules separated by another module, according to the invention provision is made for each module to have at the base of its cooler, for connection to the cold duct, a device able to assume two different configurations offering different connection lengths, so as to compensate for differences in distance between modules. A connection device of this kind may be composed of a thick plate forming the bottom of the cooler and having, in an eccentric position relative to the axis of the cooler, an opening providing communication between the interior of the cooler and a duct formed in the thickness of the said plate, at right angles to the said axis, by way of a bent connector housed in a cavity facing the said opening and dividing the said duct into two portions of unequal lengths, so that connection to the adjacent cylinder can be made either by way of one or the other of these portions depending on the orientation of the bent connector in relation to the said plate. For a cold duct connecting two contiguous modules, use will thus be made of the "long" configuration, while for a cold duct connecting two modules separated by a third module use will be made of the "short" configuration, in conjunction with an auxiliary pipe. In order to facilitate access to the bent connector, so as to turn it round when it is desired to change over from one configuration to the other, it is expedient for the eccentric opening in question to be made in a detachable auxiliary part fitting into a socket formed in the said plate and in communication with the said cavity.

A module according to the invention may include only the head of the corresponding cylinder, this head being connected leaktightly to the casing of the said cylinder, the casing forming part of the engine assembly. It may however be preferable for the module also to incorporate the cylinder casing, which is then integral with the cylinder head and is leaktightly connected at its base to the body of the engine assembly. This last-mentioned arrangement makes it possible for the seal required for the connection to the engine assembly to be situated in a region where temperature and pressure conditions are less severe, that is to say in the cold part of the cylinder.

The modular design of the heat exchangers according to the invention makes it possible to obtain at one and the same time:

- compact engine assemblies with short gas circuits which are equal in length and do not intercross;
- a kinematic system for four or six cylinders in line, with a single crankshaft, according to the most usual automobile technique;
- sub-assemblies of simple shapes identical to one another;
- excellent accessibility of the various components of the engines, thus facilitating dismantling and maintenance.

BRIEF DESCRIPTION OF THE DRAWINGS CONCERNING THE BEST EMBODIMENTS

The description given below, in conjunction with the accompanying drawings which are given by way of examples without constituting limitations, make it possible to understand clearly how the invention may be put into practice.

FIG. 3 shows a heat exchanger module according to the invention, in a vertical section on the line III—III in FIG. 5.

FIG. 4 shows the bottom of the cooler in the module shown in FIG. 3, in another configuration.

DETAILED DESCRIPTION

Figure 1:
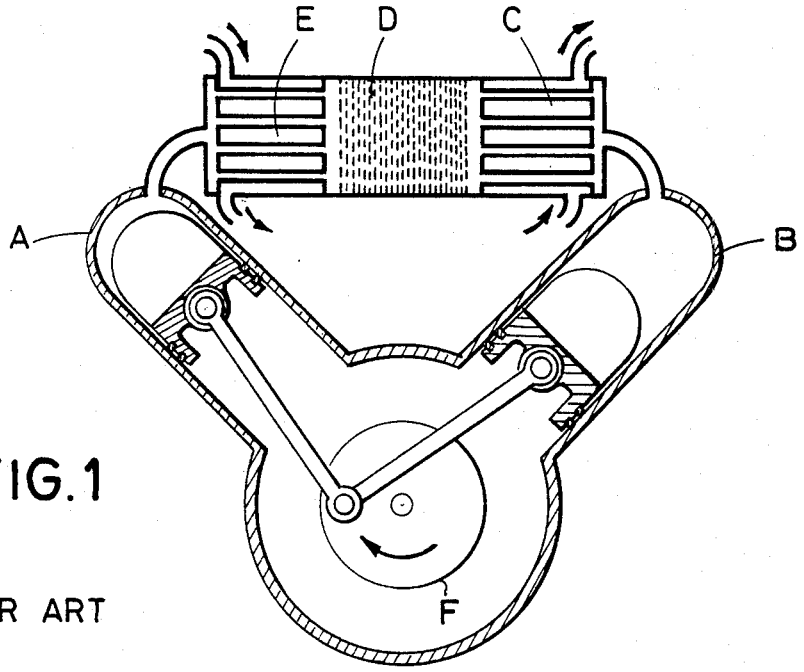
FIG. 1 PRIOR ART
FIGS. 1 and 2 are schematic showings of conventional prior art Stirling engines as discussed heretofore.
Figure 2:
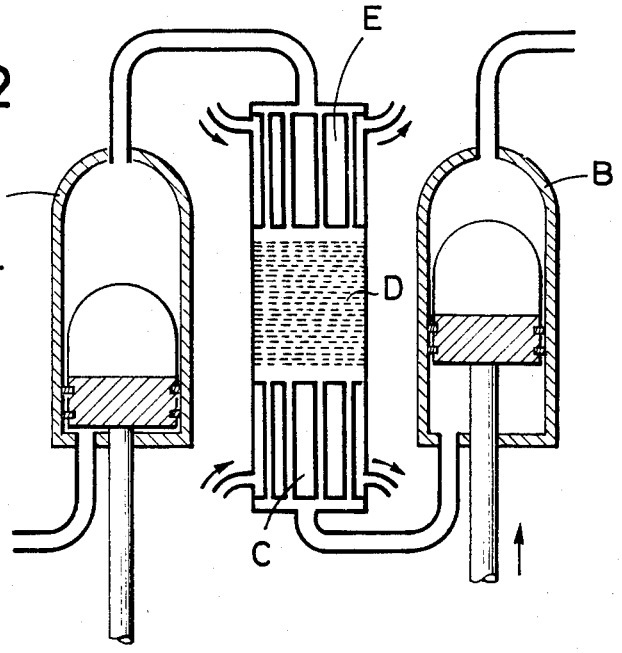
FIG. 2 PRIOR ART

In FIG. 3 can be seen the various elements shown diagrammatically in FIG. 2, namely a cylinder head 12, a heater 22, a regenerator 32, and a cooler 42, this assembly constituting, together with a cold duct connection device 52, a module according to the invention.

The heater 22, which is of the indirect heating type, comprises a housing 5 and numerous tubes 6 (of which only two have been shown) disposed in its interior and bringing the hot chamber 7 of the cylinder head 12 into communication with the regenerator 32. To the housing 5 is welded the end of a heat duct 62 carrying a heat-transfer agent (sodium, potassium or a eutectic of these two metals) between a heat source (not shown) and the heater 22. The tubes 6, which are several tens in number, have various shapes in such a manner as to have substantially the same length while being very close to one another. When brought to a temperature of the order of 700° C. they conduct the working gas (helium or hydrogen), while heating it, at a pressure which may reach 250 bars.

The regenerator 32 is composed of a housing 9 into which the tubes 6 of the heater 22 are led and which encloses a porous cylindrical block 10 composed of a compressed stack of fine wire cloths or of a block of metal foam or porous ceramic material.

The housing 9 of the regenerator 32 and the cylinder head 12 are sufficiently tall and thin for the temperature at their base to be distinctly lower than the temperature imposed at their top by the heater 22. The cross-section of the regenerator 32 constitutes a surface about twice that of the cylinder head 12.

The housing 5 of the heater 22 is rigidly joined, namely by brazing, to the cylinder head 12 and the housing 9 of the regenerator 32.

During operation the sodium (for example) is made gaseous in an evaporator situated at the other end (not shown) of the heat duct 62, by means of a heating apparatus such as an oven which may burn various fuels, a molten salt storage heater, a solar radiation receiver, and so on. In the heater 22 the sodium is condensed on the tubes 6, heating the gas contained in the latter, and returns in liquid form through the heat duct 62 to the heating apparatus. The transport of the liquid sodium is assisted either by gravity, which explains the slight slope shown in the drawing, or by a porous lining 8 consisting of fine wire cloths in the heat duct, or by a pump, in which case the gas enters and the liquid leaves by way of two different heat ducts.

The heat duct 62, the heater 22, the regenerator 32, and the top of the cylinder head 12 are enclosed in a thick covering (not shown) effecting their thermal insulation.

The cooler 42 is composed of a bundle of several hundred very thin tubes 15, which are rectilinear and parallel to the axis 16 on which the regenerator 32 and the cooler 42 are aligned, this axis being in turn parallel to the axis 48 of the cylinder head 12. These tubes are leaktightly brazed to two perforated plates 17, 18 connected together by a cylindrical sleeve 19. The top perforated plate 17 is fastened to the base of the housing 9 of the regenerator 32 by means of a double-screwthread ring 20, with the interposition of an O-ring 25. The bottom perforated plate 18 has an inlet aperture (not visible in FIG. 3) and an outlet aperture 26 for the cooling water. The water, which is introduced into a bottom chamber 27, passes into the space surrounding the tubes 15 and bounded by a cylindrical sleeve 28 by way of a hole 29 formed centrally in a transverse metal plate 30, rises along the tubes 15, and then flows back down into the annular space between the sleeve 28 and the sleeve 19, passing out through the outlet pipe 26.

Under the bottom perforated plate 18 is fastened, by means of screws 35, a thick base 36 of circular contour, in the top face of which is formed centrally a circular recess receiving a member 37 provided, parallel to the axis 16, with an eccentric opening 38 leading into a funnel-shaped inlet space 59. Below this recess there are formed in the base 36 a diametrical duct 39 and also a cavity dividing the duct 39 into two segments of unequal lengths and containing a hollow member 40 forming a connection bend between the eccentric opening 38 and the duct 39. Depending on the orientation of the member 40 in the cavity receiving it, the length, inside the base 36, of the outlet duct of the cooler 42 may be given two different values, depending on whether the long segment of the duct 39 (FIG. 3) or the short segment (FIG. 4) is used. In order to ensure that the outlet aperture 45*a* or 45*b* of whichever segment of the duct 39 is used remains on the same side, the base 36 is appropriately oriented under the cooler 42, as shown in FIGS. 3 and 4, while the aperture 45*b* or 45*a* of the unused segment is closed by a stopper 46. The outlet aperture is connected by a rigid connection assembly (flange, nuts and seal) to the base of the cylinder corresponding to an adjacent module, either directly or with the aid of an intermediate pipe 47 (see FIG. 5), the base of the cooler 42 being adjusted as required to the "long" configuration or to the "short" configuration in such a manner that the total length of the cold ducts is substantially constant.

When a module is in operation, its heater 22 is brought to a temperature of about 700° and the housing 5 of the heater undergoes elongation of 1 to 2 mm more than the engine assembly. In order to avoid excessive thermal stresses, the module is made slightly flexible at the level of the cooler 42, in which the tubes can be deformed in S-shape, with a corresponding sag. In order to give the cooler the desired flexibility while carrying the cooling water, the cylindrical sleeve 19 is composed of a flexible skin of elastomer or of a metal bellows.

In FIG. 3 two forms of construction of the portion of the cylinder which is associated with the module have been shown, one on each side of the axis 48 of the cylinder. In the arrangement shown on the left, the casing 49 of the cylinder forms part of the engine assembly and is connected to the cylinder head 12 with the interposition of a seal 50. Since this seal is subjected to severe stressing due to the pressure and temperature, which at this point may reach the respective values of 250 bars and 250° C., it may be preferable to use the arrangement shown on the right in which the cylinder head 12 and the casing 49*a* are in one piece and connected to the engine assembly 55 with an interposed seal 50*a*. The seal is thus transferred to the well cooled base of the casing, so that its life is lengthened.

For the purpose of forming a Stirling engine, a plurality of modules of the type just described are assembled and mounted (by means of fastening screws 58) on the engine assembly 55 (FIG. 5); four such modules are used in the present example. These modules 1, 2, 3, 4 are placed side by side, alternately in one direction and in the other, the cylinders being aligned along the axis 56 of a single crankshaft driving an output shaft 57. In this Figure can be seen the cylinder heads 11, 12, 14, the heaters 21, 23, 24, the regenerator 31, the coolers 41, 42, 43, the connection device 54, and the four heat ducts 61, 62, 63, 64. The base of the cooler 42 of the module 2, mounted in the "long" configuration shown in FIG. 3, is connected directly to the base of the cylinder corresponding to the head 11 of the module 1; the base of the cooler 43 of the module 3 is similarly connected to the base of the cylinder corresponding to the head 14 of the module 4. A similar connection, but with the interposition of a pipe 47, is made between the base of the coolers 41 and 44 (in the "short" configuration shown in FIG. 4) and the base of the cylinders corresponding to the heads 13 and 12 respectively. It can clearly be seen in FIG. 5 that all the cold ducts are approximately of the same length and consequently have the same volume. The modules thus operate in the order 1-2-4-3. The movements of the pistons in the cylinders are offset 90° in the same order, in accordance with the diagram shown in FIG. 2, the engine crankshaft being shaped accordingly.

The invention is also applicable to the case of a Stirling engine having six cylinders in line. The heat exchanger modules then operate in the order 1-2-4-6-5-3. The movements of the pistons in the cylinders are offset 120° in the same order, the engine crankshaft being shaped accordingly. This has the consequence that the variations of the cold volume in the engine units according to the diagram shown in FIG. 2 are offset 60° in relation to those of the hot volumes (instead of 90° in the case of the four-cylinder engine). The cold connections between the coolers of the modules 2 and 5 and the cylinders corresponding to the modules 1 and 6 respectively are made by direct screw connection of the cooler bases (in the configuration shown in FIG. 3), while the cold connections between the coolers of modules 4, 1, 6 and 3 and the cylinders corresponding to modules 2, 3, 4 and 5 respectively require the interposition of intermediate pipes 47, the bases of the coolers of these modules being in the configuration shown in FIG. 4.

Figure 5:
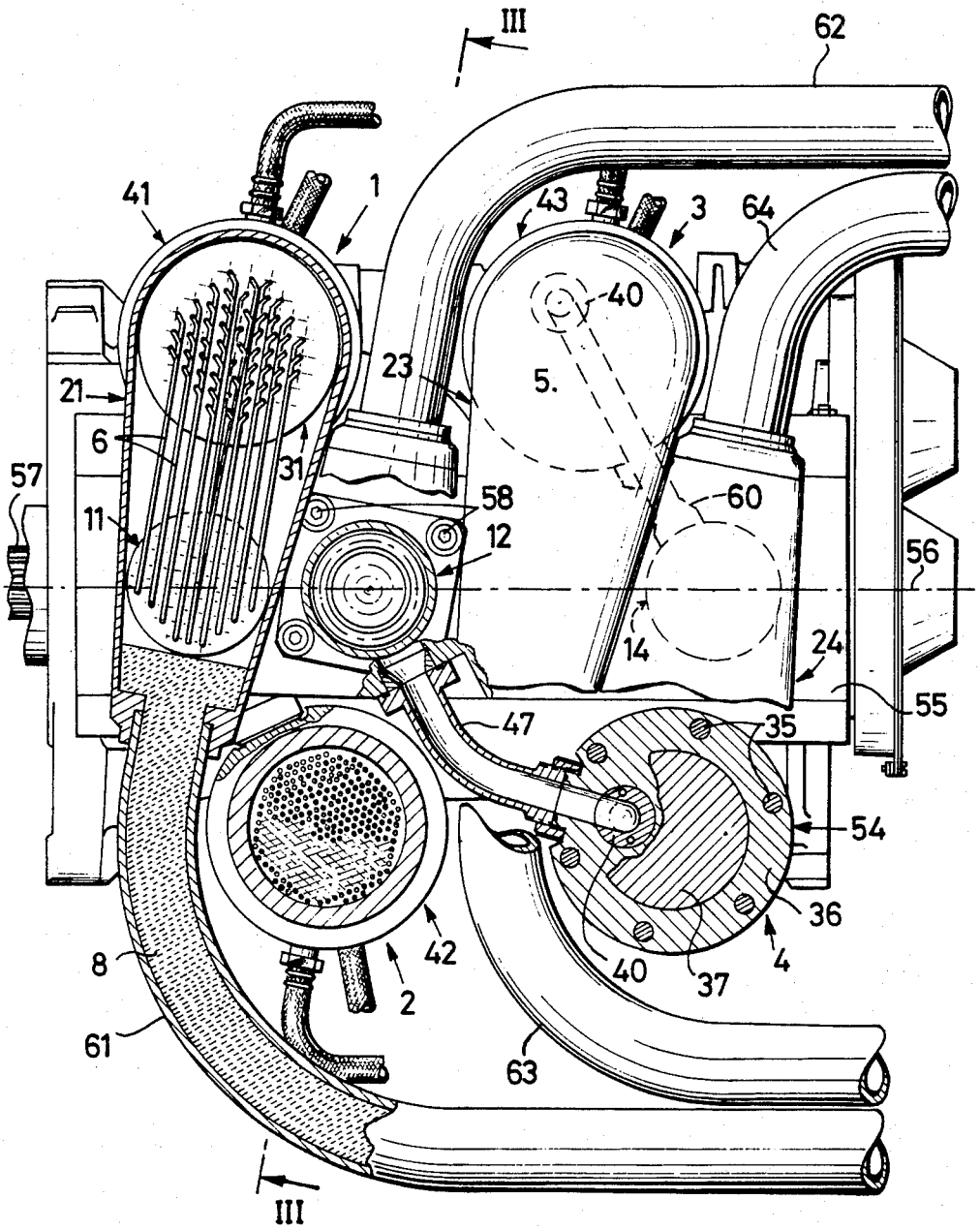
FIG. 5 is a plan view of a Stirling engine comprising four cylinders in line and formed by combining four modules according to the invention on an engine assembly.

The head ducts 61, 62, 63, 64 welded to the various heat exchanger modules 1, 2, 3, 4 are not in general all identical, as would appear from FIG. 5. Their shape is adapted to the connections to be made to the heat source or sources of the engine.

What is claimed is:

1. A modular heat exchanger for a Stirling engine having cylinders and cylinder heads, said unit comprising a tubular heater, a regenerator and a tubular cooler, the regenerator and cooler forming an assembly of generally cylindrical shape whose axis is parallel to the axis of the head of a first cylinder, said tubular heater having a housing rigidly connecting said head of said first cylinder and the regenerator, a wall of said unit being flexible and capable of absorbing the effects of thermal expansion of the heater, said cooler having a plate at its base comprising an opening parallel and eccentric to the axis of the cooler and connecting with said cooler, a duct extending transversely across said plate, said opening meeting said duct at a point nearer the periphery of the plate in one direction than in the opposite direction, a connecting member connecting said opening with said duct in one direction and means connecting said duct to the base of a second cylinder.

2. A unit as claimed in claim 1, wherein said first cylinder has a casing, the cylinder head being tightly connected to said casing.

3. A unit as claimed in claim 1, wherein the cylinder head is integral with a casing of the corresponding cylinder, said casing being tightly connected at its base to the body of the engine.

4. A modular heat exchange unit for a Stirling engine having cylinders and cylinder heads, said unit comprising a tubular heater, a regenerator and a tubular cooler, the regenerator and cooler forming an assembly of generally cylindrical shape whose axis is parallel to the axis of the head of a first cylinder, said tubular heater having a housing rigidly connecting said head of said first cylinder and the regenerator, a wall of said unit being flexible and capable of absorbing the effects of thermal expansion of the heater, a thick plate at the base of the cooler, having an opening situated eccentrically relative to the axis of the cooler and communicating the interior of the cooler with a duct formed in said plate perpendicularly to the said axis, a bent connector housed in a cavity facing the opening and dividing the said duct into two portions of unequal lengths, and means connecting one of said portions to a second cylinder, depending on the orientation of the bent connector relative to the plate.

5. A unit as claimed in claim 1, wherein the eccentrically located opening is formed in a detachable member fitted into a recess formed in the said plate and communicating with the said cavity.

* * * * *